US008175504B2

(12) United States Patent
Aruga et al.

(10) Patent No.: US 8,175,504 B2
(45) Date of Patent: May 8, 2012

(54) IMAGE FORMING APPARATUS AND IMAGE FORMING METHOD

(75) Inventors: Tomohiro Aruga, Matsumoto (JP); Masahiro Maeda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 424 days.

(21) Appl. No.: 12/471,221

(22) Filed: May 22, 2009

(65) Prior Publication Data

US 2009/0297231 A1 Dec. 3, 2009

(30) Foreign Application Priority Data

May 29, 2008 (JP) ..... 2008-140406

(51) Int. Cl.
*G03G 15/08* (2006.01)

(52) U.S. Cl. ..... 399/285; 399/286

(58) Field of Classification Search ..... 399/55, 399/279, 285
See application file for complete search history.

(56) References Cited

U.S. PATENT DOCUMENTS

| | | | | |
|---|---|---|---|---|
| 7,751,760 | B2 * | 7/2010 | Koike et al. | 399/285 |
| 2001/0055503 | A1 * | 12/2001 | Kin et al. | 399/284 |
| 2006/0210320 | A1 * | 9/2006 | Nakagawa et al. | 399/265 |

FOREIGN PATENT DOCUMENTS

| | | |
|---|---|---|
| JP | 2000-056558 | 2/2000 |
| JP | 2001-066876 | 3/2001 |
| JP | 2007-233195 | 9/2007 |
| JP | 2008-083554 | 4/2008 |

* cited by examiner

*Primary Examiner* — David Gray
*Assistant Examiner* — Frederick Wenderoth
(74) *Attorney, Agent, or Firm* — DLA Piper LLP (US)

(57) ABSTRACT

An image forming apparatus includes an image carrier that carries an electrostatic latent image on a surface thereof, a toner carrying roller that is disposed to face the image carrier and rotates in a predetermined rotation direction with charged toner carried on a surface thereof so as to transport the toner in an opposing position for facing the image carrier, and a bias applying unit that develops the electrostatic latent image with the toner by applying an AC voltage as a developing bias to the toner carrying roller. In addition, periodical concavo-convexes that are formed of a plurality of convex portions arranged at a constant pitch in a circumferential direction and concave portions that surround the plurality of convex portions are formed on the surface of the toner carrying roller. When the arrangement pitch is denoted by P, the frequency of the developing bias is denoted by F, and the moving speed of the surface of the toner carrying roller for the circumferential direction is denoted by V, a quotient acquired from dividing V by F is a value acquired from multiplying P by a natural number or an approximately natural number.

7 Claims, 8 Drawing Sheets

FIG. 7A n=1
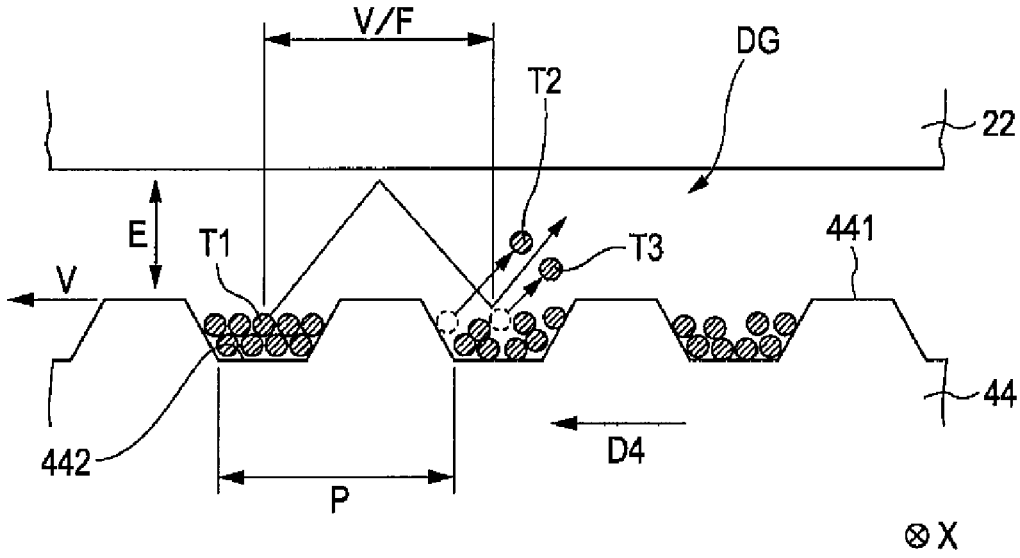
FIG. 7B n=2
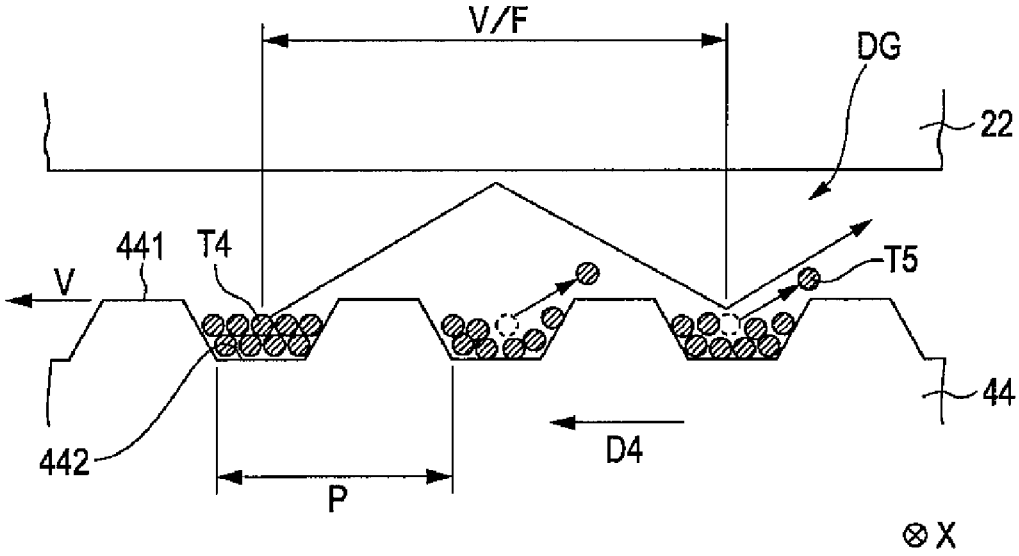

IMAGE FORMING APPARATUS AND IMAGE FORMING METHOD

BACKGROUND

1. Technical Field

The present invention relates to an image forming apparatus and an image forming method that develops an electrostatic latent image with toner by using a toner carrying roller having a surface on which periodic concave-convexes are disposed.

2. Related Art

Recently, developing devices for developing an electrostatic latent image carried on an image carrier with toner and image forming apparatuses having the developing devices in which a toner carrying roller that is formed in an approximate cylinder shape and carries toner on the surface is disposed to face an image carrier have been widely used. The applicant of this application, in order to enhance the characteristics of toner that is carried on the surface of the toner carrying roller, has disclosed an image forming apparatus, which employs a toner carrying roller in which convex portions that are regularly disposed on the surface of the roller formed in a cylinder shape and concave portions that surround the peripheries of the convex portions are disposed, in advance (see JP-A-2007-233195 (FIG. 6)). Under such a structure, the concave-convex patterns formed on the surface are managed to be uniform, and accordingly, there is an advantage that the thickness, the charged amount, or the like of a toner layer that is carried on the surface of the roller can be controlled in an easy manner.

On the surface of the toner carrying roller, the toner is mainly carried in the concave portions. Thus, the toner carrying roller has a relatively small effective surface area that contributes to transport of the toner, for example, compared to a toner carrying roller having a surface that is blast processed. Even when a height difference of the concave-convex is configured to be large for supplementing a decrease in the amount of transport of the toner accompanied with the small effective surface area of the toner carrying roller, toner that is carried in a deep portion of the concave portion cannot easily contribute to a developing process, and thereby the efficiency of the developing process is not sufficient. Accordingly, there is a case where the density of an image to be formed is insufficient.

As described above, in the image forming apparatuses and the image forming methods that use the toner carrying roller having the surface on which regular concave-convexes are disposed, for acquiring sufficient image density, the toner carried in the toner carrying roller should be effectively contributed to the developing process so as to increase the efficiency of the developing process.

SUMMARY

An advantage of some aspects of the invention is that it provides an image forming apparatus and an image forming method, which use a toner carrying roller having the surface on which regular concave-convexes are disposed, capable of having the toner carried in the toner carrying roller to effectively contribute to a developing process so as to acquire sufficient image density.

According to a first aspect of the invention, there is provided an image forming apparatus. The image forming apparatus includes: an image carrier that carries an electrostatic latent image on a surface thereof; a toner carrying roller that is disposed to face the image carrier and rotates in a predetermined rotation direction with charged toner carried on a surface thereof so as to transport the toner in an opposing position for facing the image carrier; and a bias applying unit that develops the electrostatic latent image with the toner by applying an AC voltage as a developing bias to the toner carrying roller. In addition, periodical concavo-convexes that are formed of a plurality of convex portions arranged at a constant pitch in a circumferential direction and concave portions that surround the plurality of convex portions are formed on the surface of the toner carrying roller. When the arrangement pitch is denoted by P, the frequency of the developing bias is denoted by F, and the moving speed of the surface of the toner carrying roller for the circumferential direction is denoted by V, a quotient acquired from dividing V by F is a value acquired from multiplying P by a natural number or an approximately natural number.

In other words, according to the above-described aspect of the invention, the following equation is satisfied for any arbitrary natural number n.

$$V/F \approx n \cdot P$$

The left side of this relational expression represents a distance by which the surface of the toner carrying roller that moves at the speed V advances during a time period (1/F) corresponding to one period of the developing bias. Thus, this relational expression represents that the distance by which the surface of the toner carrying roller advances during one period of the developing bias is the same as or almost the same as a value acquired from multiplying the arrangement pitch P of the convex portions by a natural number. In other words, the above-described aspect is characterized by defining relationship of three parties including the arrangement pitch of the convex portions formed on the surface of the toner carrying roller, the peripheral speed, and the frequency of the developing bias.

By the action of an alternating electric field that is formed in accordance with an AC voltage applied to the toner carrying roller as a developing bias, charged toner is driven to reciprocate between the surface of the image carrier and the surface of the toner carrying roller. When the above-described relation is satisfied, the surface of the toner carrying roller moves by a distance acquired from multiplying the arrangement pitch P of the convex portions by an almost natural number until toner lifted off from the concave portion of the surface of the toner carrying roller is returned to the surface of the toner carrying roller again. Accordingly, the toner coming out from the concave portion flies into another concave portion. Since this toner is accelerated by the electric field, the toner performs an action for sending out toner remaining in the concave portion. The toner sent out as described above additionally flies into another concave portion so as to induce flight-out of new toner.

As described above, according to the above-described aspect, by having the reciprocating movement of the toner according to the developing bias and the movement of the surface of the toner carrying roller to be synchronized with each other, the toner carried in the concave portion can be effectively lifted off. Accordingly, more pieces of toner can contribute to the developing process. As a result, the efficiency of the developing process is increased, and thereby an image can be formed with sufficient image density.

In addition, according to the above-described aspect of the invention, ideally a quotient acquired from dividing V by F is a value acquired from multiplying P by a natural number. In other words, it is apparent that satisfaction of equality in the above-described relational expression is preferable. However, the equality may be slightly deviated. The reason is as follows. Under a condition in which the equality in the above-described relational expression is slightly deviated, a probability that the toner coming out from the concave portion does not return to the concave portion and is attached to the convex portion is gradually increased during a period in which the reciprocating movement of the toner is repeated. However, the reciprocating movement of the toner occurs only in a small area in which the image carrier and the toner carrying roller have been brought into contact with each other the latest. Accordingly, the number of times of reciprocating of the toner is limited. According to the technical idea of the above-described aspect, the toner needs to be moved from the concave portion to the concave portion only during the reciprocating movement of the limited number of times. As a result, the equality in the relational expression does not need to be satisfied precisely.

In addition, in order to perform flight of the toner out of the concave portion most efficiently, it is preferable that the number of times of reciprocating of the toner is set to be large as possibly as can be. In other words, when the value of n is 1 in the above-described relational expression, the advantages of the above-described aspect of the invention become the most prominent.

In addition, in an image forming apparatus in which the image carrier and the toner carrying roller are disposed to face each other with a predetermined gap interposed therebetween, the advantages of the aspects of the invention are prominent. In such an apparatus, the developing process is performed by reciprocating flight of the toner in the gap between the image carrier and the toner carrying roller. The toner flying from the concave portion induces flight of the toner in another concave portion, and accordingly, a high efficiency of the developing process is acquired.

In addition, the above-described image forming apparatus may be configured to include further a regulating unit that is brought into contact with the surface of the toner carrying roller on an upstream side relative to the opposing position in the rotation direction of the toner carrying roller and regulates attachment of the toner to top faces of the plurality of convex portions. Under such a configuration, carrying the toner is almost limited to the concave portions, and thus, it is very important to increase the efficiency of the developing process. By applying the invention to the apparatus having the above-described configuration, sufficient image density can be acquired by increasing the efficiency of the developing process.

In addition, the above-described image forming apparatus may further include a sealing member that prevents leakage of the toner from a housing is interposed in a gap between the surface of the toner carrying roller and the housing on a downstream side relative to the opposing position in the direction of rotation of the toner carrying roller, wherein a shaft of the toner carrying roller is attached to the housing, which stores the toner therein, so as to be rotatable. Under such a configuration, toner attached to the convex portion may be pressed between the convex portion and the sealing member so as to be fixed to the sealing member or the toner carrying roller. However, according to an embodiment of the invention, the toner carried in the concave portion is returned to the concave portion. Accordingly, toner that is attached to the convex portion on the downstream side relative to the opposing position of the image carrier and the toner carrying roller is decreased. As a result, an advantage that such fixation cannot easily occur can be acquired.

According to a second aspect of the invention, there is provided an image forming apparatus. The image forming apparatus includes: an image carrier that carries an electrostatic latent image on a surface thereof; a toner carrying roller that is disposed to face the image carrier and rotates in a predetermined rotation direction with charged toner carried on a surface thereof so as to transport the toner in an opposing position for facing the image carrier; and a bias applying unit that develops the electrostatic latent image with the toner by applying an AC voltage as a developing bias to the toner carrying roller. In addition, a plurality of grooves that is arranged at a constant pitch in a circumferential direction is disposed on the surface of the toner carrying roller. When the arrangement pitch is denoted by P, the frequency of the developing bias is denoted by F, and the moving speed of the surface of the toner carrying roller for the circumferential direction is denoted by V, a quotient acquired from dividing V by F is a value acquired from multiplying P by a natural number or an approximately natural number.

In the description above, the relationship of three parties including the arrangement pitch of the convex portions, the peripheral speed of the toner carrying roller, and the frequency of the developing bias has been described. Additionally, the concave portions may be regarded as grooves that are periodically disposed in the toner carrying roller. In such a case, an embodiment of the invention may be defined by relationship of the arrangement pitch of the grooves, the peripheral speed of the toner carrying roller, and the frequency of the developing bias. The advantages are the same as those described above. In addition, the groove is not limited to a groove that extends in a direction perpendicular to the circumferential direction, that is, an axis direction that is parallel to the rotation direction of the toner carrying roller.

According to a third aspect of the invention, there is provided an image forming method. The image forming method includes: forming an electrostatic latent image on a surface of an image carrier; and developing the electrostatic latent image with toner by applying an AC voltage as a developing bias to a toner carrying roller by disposing the toner carrying roller, which rotates in a predetermined direction with charged toner carried on a surface thereof, so as to face the image carrier. In addition, periodical concavo-convexes that are formed of a plurality of convex portions arranged at a constant pitch in a circumferential direction and concave portions that surround the plurality of convex portions are formed on the surface of the toner carrying roller. When the arrangement pitch is denoted by P, the frequency of the developing bias is denoted by F, and the moving speed of the surface of the toner carrying roller for the circumferential direction is denoted by V, a quotient acquired from dividing V by F is a value acquired from multiplying P by a natural number or an approximately natural number. According to the above-described image forming method, same as the above-described image forming apparatus, an image having sufficient image density can be formed with a high efficiency of the developing process.

BRIEF DESCRIPTION OF THE DRAWINGS

The invention will be described with reference to the accompanying drawings, wherein like numbers reference like elements.

FIGS. 7A and 7B are diagrams showing the relationship between an arrangement pitch of convex portions and the amount of movement of the surface of a developing roller, according to an embodiment of the embodiment.

DESCRIPTION OF EXEMPLARY EMBODIMENTS

Figure 1:
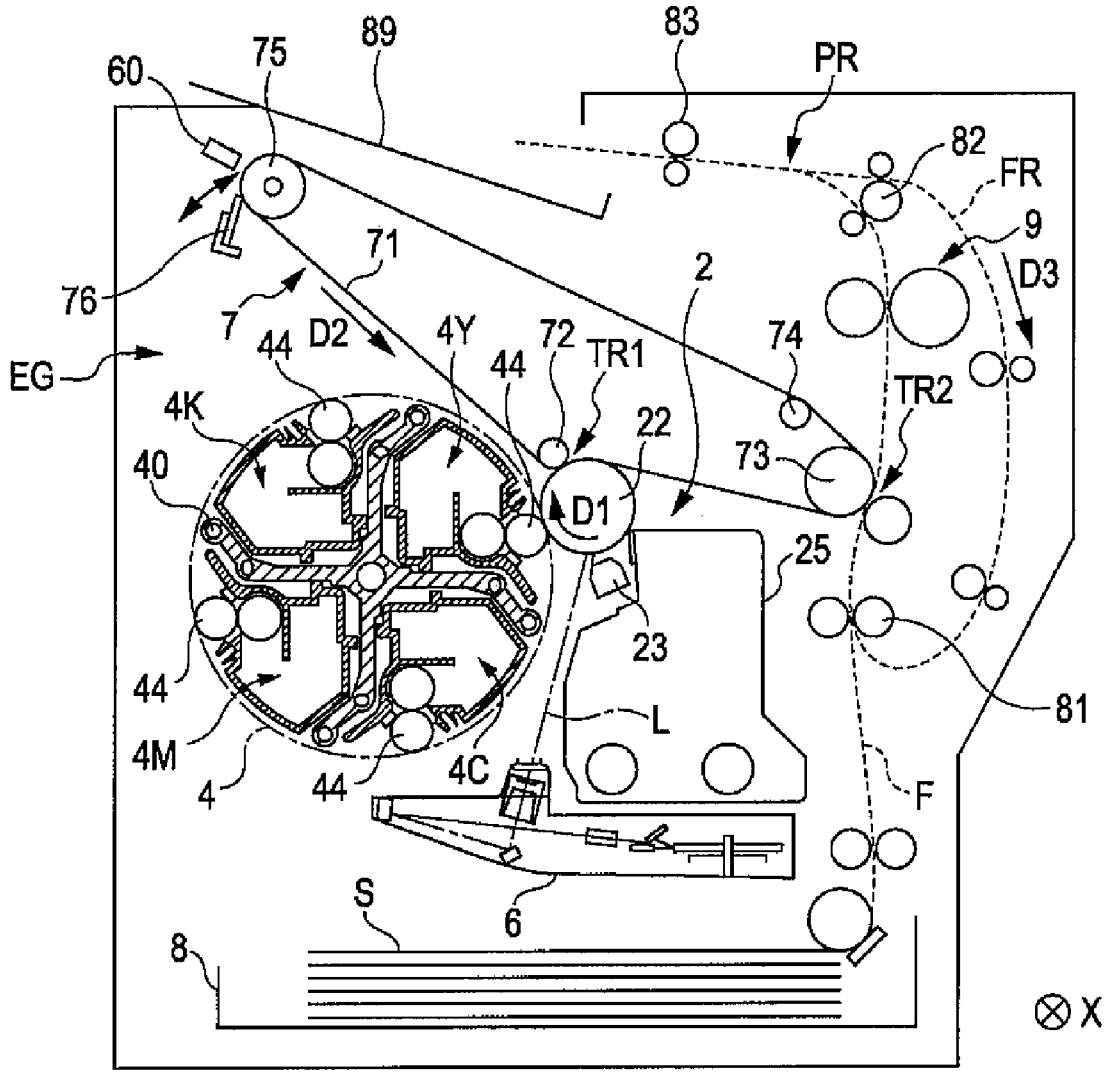
FIG. 1 is a diagram showing an image forming apparatus according to an embodiment of the invention.
Figure 2:
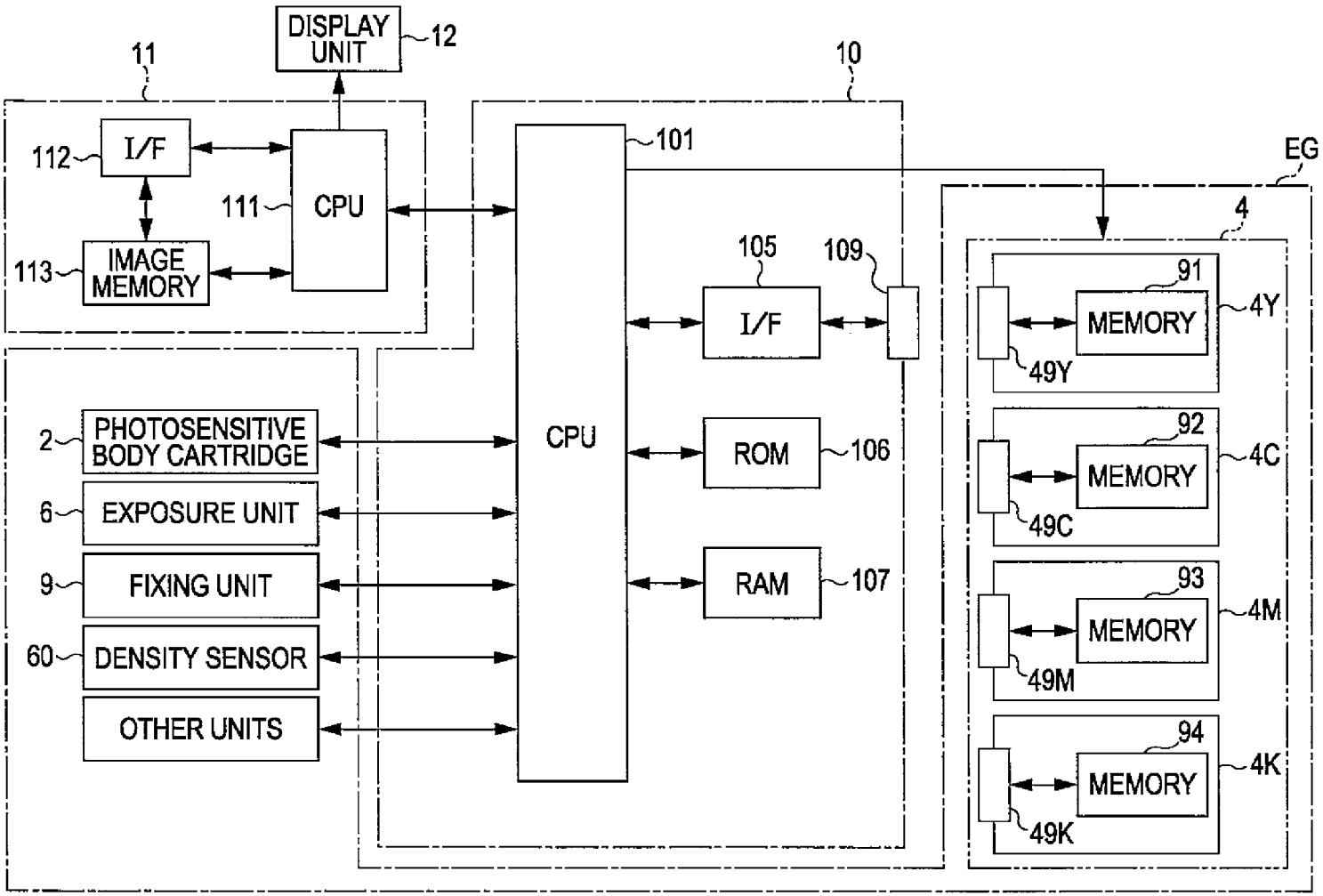
FIG. 2 is a block diagram showing the electrical configuration of the image forming apparatus shown in FIG. 1.

FIG. 1 is a diagram showing an image forming apparatus according to an embodiment of the invention. In addition, FIG. 2 is a block diagram showing the electrical configuration of the image forming apparatus shown in FIG. 1. This apparatus is an image forming apparatus that forms a full color image by superimposing toner (developers) of four colors including a yellow (Y) color, a cyan (C) color, a magenta (M) color, and a black (K) color or forms a monochrome image by using toner of the black (K) color only. When an image signal is supplied to a main controller 11 of this image forming apparatus from an external apparatus such as a host computer, a CPU 101 that is disposed in an engine controller 10 controls sections of an engine unit EG in accordance with a direction transmitted from this main controller 11 so as to perform a predetermined image forming operation and whereby forming an image corresponding to the image signal on a sheet S.

In this engine unit EG, a photosensitive body 22 is disposed to be rotatable in the direction D1 of an arrow shown in FIG. 1. On the periphery of this photosensitive body 22, a charging unit 23, a rotary developing unit 4, and a cleaning unit 25 are disposed along the rotation direction D1. To the charging unit 23, a predetermined charging bias is applied. The charging unit 23 charges the outer circumferential face of the photosensitive body 22 at a predetermined surface electric potential. The cleaning unit 25 removes toner remaining to be attached on the surface of the photosensitive body 22 after primary transfer and collects the remaining toner into a waste toner tank disposed inside. The photosensitive body 22, the charging unit 23, and the cleaning unit 25 integrally configure a photosensitive body cartridge 2. This photosensitive body cartridge 2 can be integrally attached to or detached from an apparatus main body.

Then, a light beam L is irradiated from an exposure unit 6 toward the outer circumferential face of the photosensitive body 22 that is charged by the charging unit 23. This exposure unit 6 forms an electrostatic latent image corresponding to an image signal by exposing the light beam L on the photosensitive body 22 in accordance with the image signal supplied from an external apparatus.

The electrostatic latent image formed as described above is developed by the developing unit 4 by using toner. In other words, according to this embodiment, the developing unit 4 is configured by a support frame 40 that is disposed to be rotatable around a rotation axis perpendicular to the sheet face of FIG. 1 and a cartridge that is detachably attached to the support frame 40. The developing unit 4 includes a developing section 4Y for a yellow color, a developing section 4C for a cyan color, a developing section 4M for a magenta color, and a developing section 4K for a black color that contain toner of each color. This developing unit 4 is controlled by the engine controller 10. When the developing unit 4 is driven to rotate based on a control direction transmitted from this engine controller 10, and the developing sections 4Y, 4C, 4M, and 4K are selectively positioned in a predetermined developing position so as to face the photosensitive body 22 with a predetermined gap interposed therebetween, a developing roller 44 that is disposed in the developing section and carries toner of a selected color is disposed to face the photosensitive body 22 and applies toner to the surface of the photosensitive body 22 in the opposing position from the developing roller 44. Accordingly, the electrostatic latent image on the photosensitive body 22 is rendered as an image of the selected toner color.

Figure 3:
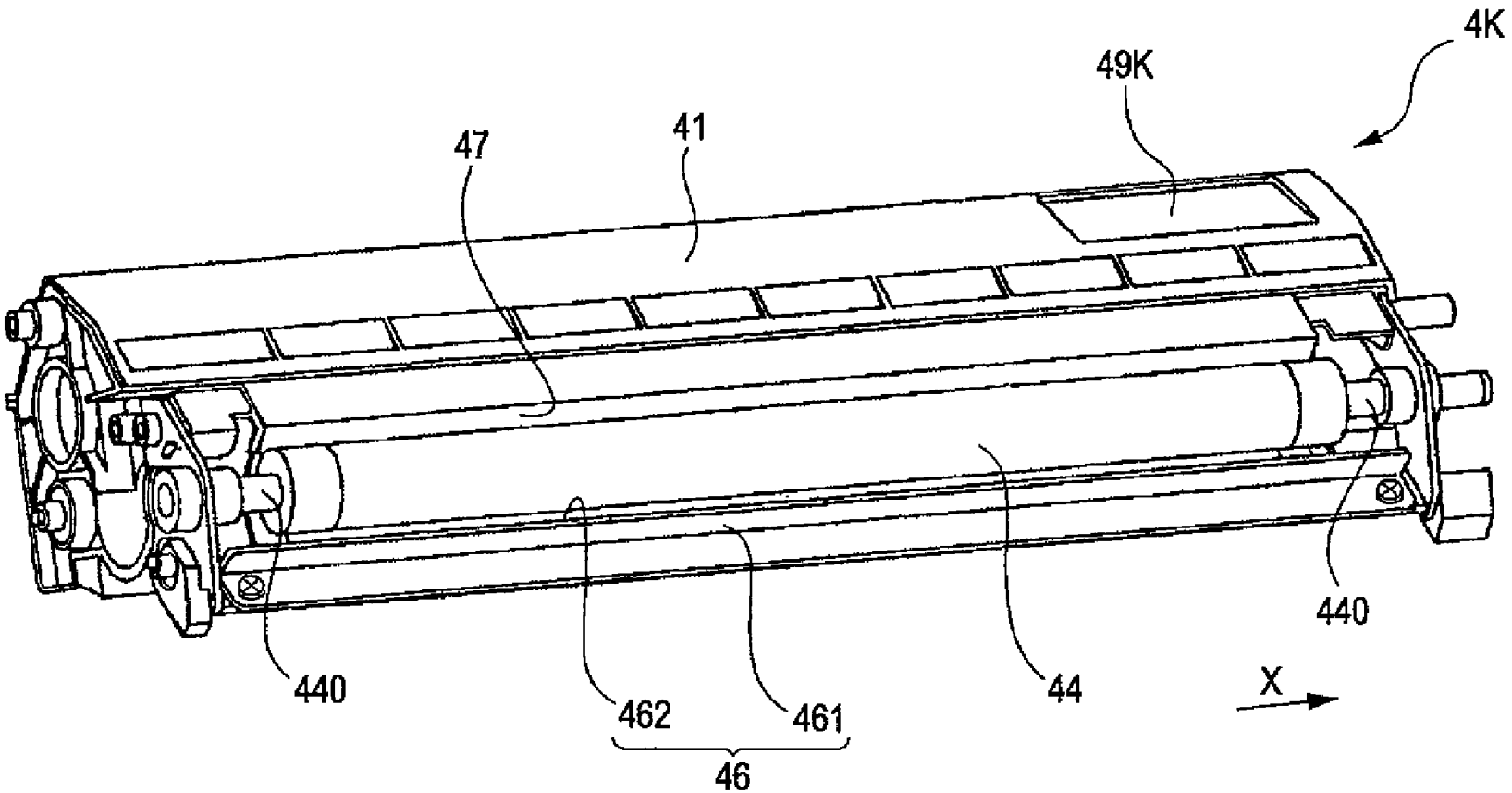
FIG. 3 is a diagram showing the external appearance of a developing section according to an embodiment of the invention.
Figure 4A:
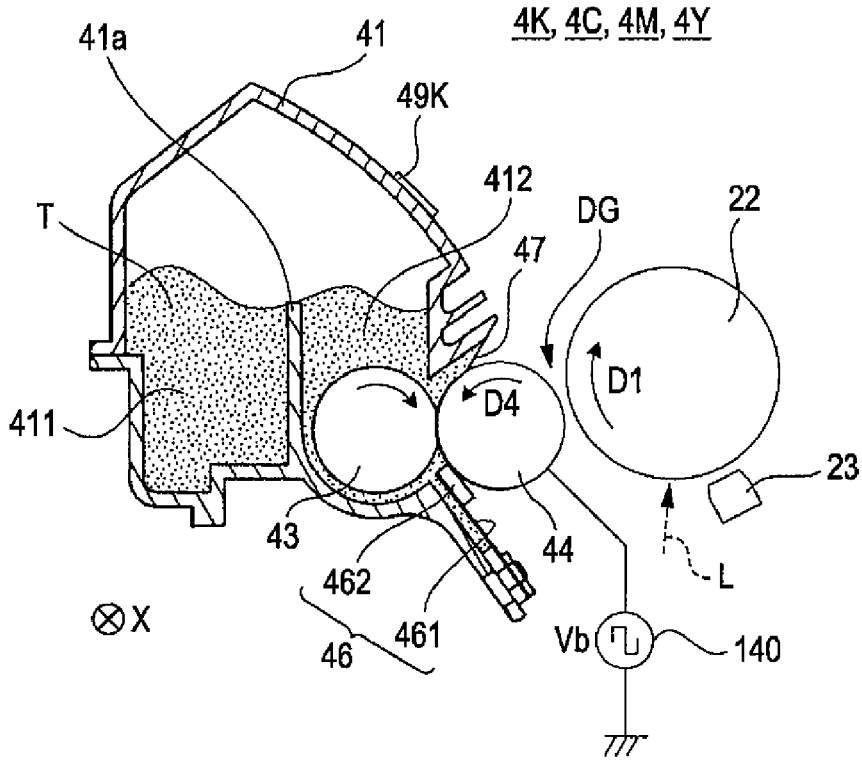
FIGS. 4A and 4B are diagrams showing the structure of the developing section and the waveform of a developing bias according to an embodiment of the invention.
Figure 4B:
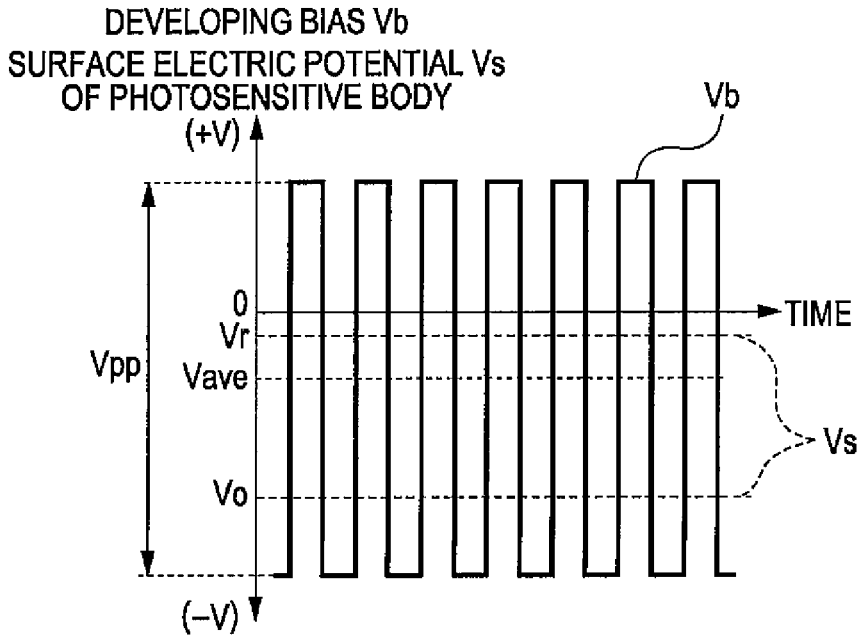

FIG. 3 is a diagram showing the external appearance of the developing section. FIGS. 4A and 4B are diagrams showing the structure of the developing section and the waveform of a developing bias. In particular, FIG. 4A is a cross-sectional view showing the structure of the developing section. In addition, FIG. 4B is a diagram showing relationship between the waveform of the developing bias and the surface electric potential of the photosensitive body. All the developing sections 4Y, 4C, 4M, 4K have a same configuration. Thus, here, the configuration of the developing section 4K will be additionally described in detail with respect to FIG. 3 and FIG. 4A. However, the structures and the functions of other developing sections 4Y, 4C, and 4M are the same as those of the developing section 4K.

In this developing section 4K, a supply roller 43 and a developing roller 44 have axes attached to a housing 41, which houses nonmagnetic one-component toner T therein, to be rotatable. When the developer 4K is positioned in the developing position, the developing roller 44 is positioned in the opposing position with a developing gap DG from the photosensitive body 2 formed. In addition, the rollers 43 and 44 are engaged with a rotation driving portion (not shown), which is disposed on the main body side, so as to rotate in a predetermined direction. The supply roller 43, for example, is formed of an elastic material such as urethane foam rubber or silicon rubber in a cylinder shape. In addition, the developing roller 44 is formed of a metal such as copper, aluminum, or stainless steel or an alloy in a cylinder shape. As two rollers 43 and 44 rotate with being brought into contact with each other, toner is rubbed and applied to the surface of the developing roller 44, and whereby a toner layer of a predetermined thickness is formed on the surface of the developing roller 44. According to this embodiment, negatively charged toner is used. However, positively charged toner may be used.

The inner space of the housing 41 is partitioned into a first chamber 411 and a second chamber 412 by a partition wall 41*a*. The supply roller 43 and the developing roller 44 are disposed together in the second chamber 412. In accordance with rotation of these rollers, toner located inside the second chamber 412 flows to be agitated, and whereby the toner is supplied to the surface of the developing roller 44. On the other hand, toner that is stored in the first chamber 411 is separated from the supply roller 43 and the developing roller 44, and accordingly, the toner does not flow in accordance with rotation of the rollers. This toner is mixed and agitated with the toner stored in the second chamber 412 as the developing unit 4 rotates while maintaining the developing section.

As described above, in this developing section, a second chamber 412 having a relatively small volume is arranged by partitioning the inside of the housing into two chambers and surrounding the periphery of the supply roller 43 and the developing roller 44 with a side wall and the partition wall 41*a* of the housing 41. Accordingly, even when the remaining amount of the toner decreases, the toner can be supplied to an area near the developing roller 44 efficiently. In addition, an augerless structure in which an agitating member (auger) for agitating toner is omitted is implemented inside the developing section by performing supply of toner from the first chamber 411 to the second chamber 412 and agitation of total toner by rotating the developing unit 4.

In addition, in this developing section 4K, a regulating blade 46 that is used for regulating the thickness of a toner layer that is formed on the surface of the developing roller 44 to be a predetermined thickness is disposed. This regulating blade 46 is configured by a plate-shaped member 461, which is formed of a stainless steel, phosphor bronze, or the like, having elasticity and an elastic member 462, which is formed of a resin member such as silicon rubber or urethane rubber, installed to a front end portion of the plate-shaped member 461. A rear end portion of this plate-shaped member 461 is firmly fixed to the housing 41. In addition, in the direction D4 of rotation of the developing roller 44 that is denoted by an arrow shown in FIG. 4, the elastic member 462 attached to the front end portion of the plate-shaped member 461 is disposed so as to be located on the upstream side relative to the rear end portion of the plate-shaped member 461. Then, the elastic member 462 is elastically brought into contact with the surface of the developing roller 44 so as to form a regulating nip, and thereby the toner layer that is formed on the surface of the developing roller 44 is regulated to have a predetermined thickness finally.

The toner layer that is formed on the surface of the developing roller 44 as described above is sequentially transported to positions facing the photosensitive bodies 2 having the surfaces on which electrostatic latent images are formed in accordance with rotation of the developing roller 44. Then, a developing bias supplied from the bias power source 140 that is controlled by the engine controller 10 is applied to the developing roller 44. As shown in FIG. 4B, after the photosensitive body 22 is charged uniformly by the charging unit 23, the surface electric potential Vs of the photosensitive body 22 decreases to about a remaining electric potential Vr in an exposed portion onto which the light beam L is irradiated from the exposure unit 6, and the surface electric potential Vs of the photosensitive body 22 is an electric potential Vo, which is almost uniform, in a non-exposed portion onto which the light beam L is not irradiated. On the other hand, the developing bias Vb applied to the developing roller 44 is a square-wave AC voltage that is acquired from superimposing a DC electric potential Vave. In addition, a peak-to-peak voltage is denoted by a sign Vpp. By applying the developing bias Vb, the toner carried on the developing roller 44 flies in the developing gap DG so as to be partially attached to each portion of the surface of the photosensitive body 22 in accordance with the surface electric potential Vs. Accordingly, the electrostatic latent image on the photosensitive body 22 is rendered as a toner image of the toner color.

As the developing bias voltage Vb, for example, a square-wave voltage having a frequency, to be described later, at the peak-to-peak voltage Vpp of 1500 V may be used. In addition, an electric potential difference of the DC component Vave of the developing bias voltage Vb and the remaining electric potential Vr of the photosensitive body 22 becomes so-called developing contrast so as to influence on the image density. Accordingly, the DC component Vave may be set to a value needed for acquiring predetermined image density.

In addition, in the housing 41, a sealing member 47 that is tightly bonded to the surface of the developing roller 44 on the downstream side relative to the opposing position for facing the photosensitive body 22 in the direction of rotation of the developing roller 44 is disposed. The sealing member 47 is formed of a resin material such as poly ethylene, nylon, or fluoride resin that has flexibility. The sealing member 47 is a band-shaped film that extends along direction X that is parallel to the rotation axis of the developing roller 44. One end of the sealing member 47 in a short-side direction (a direction along the direction of rotation of the developing roller 44) that is perpendicular to the longitudinal direction X is firmly fixed to the housing 41, and the other end thereof is brought into contact with surface of the developing roller 44. The other end is brought into contact with the developing roller 44 in so-called a trail direction so as to face the downstream side of the developing roller 44 in the rotation direction D4. Thus, the sealing member 47 guides the toner remaining on the surface of the developing roller 44 that has passed the opposing position for facing the photosensitive body 22 to the inside of the housing 41 and prevents external leakage of the toner located inside the housing.

Figure 5:
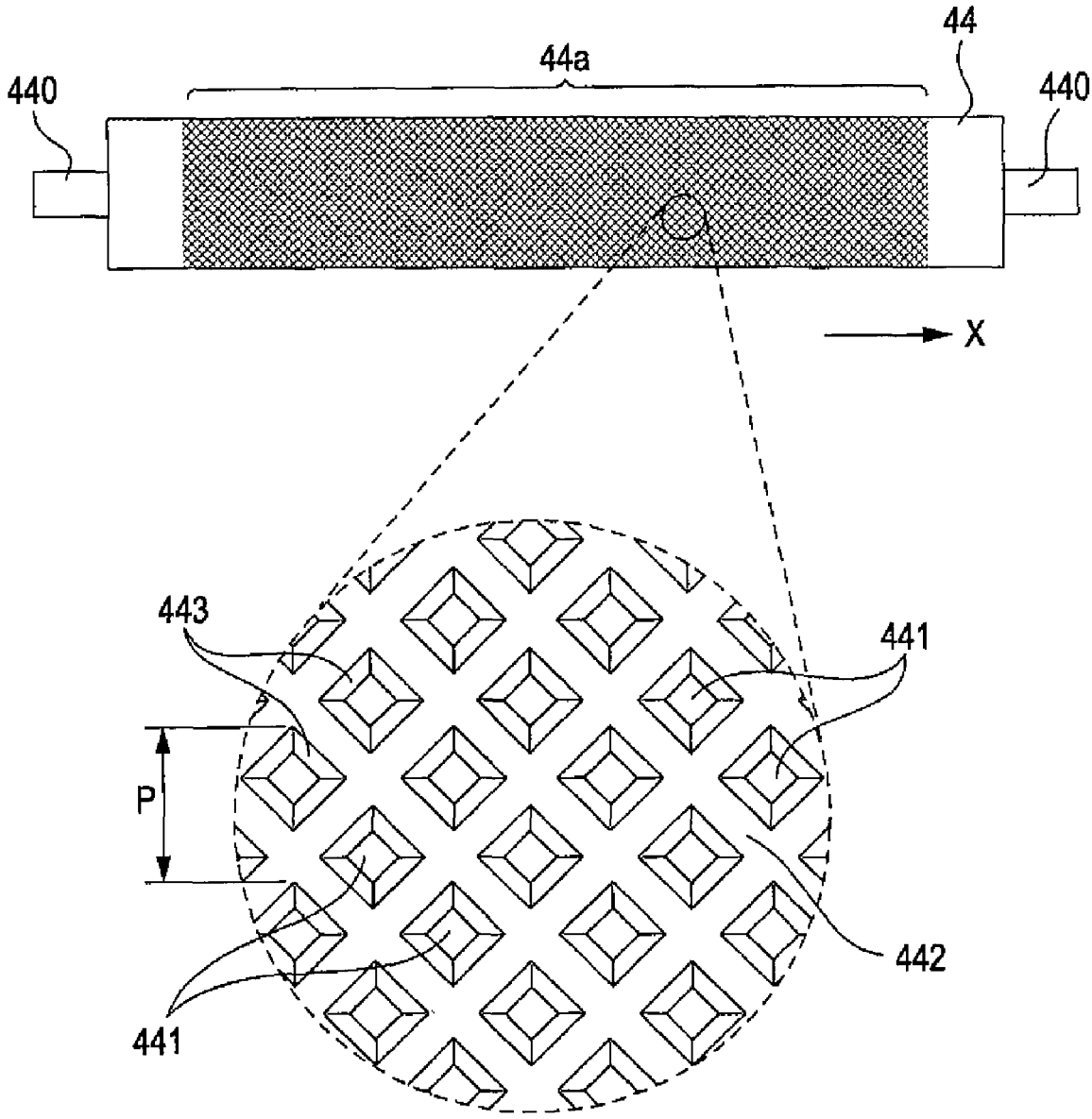
FIG. 5 is a diagram showing a developing roller and a partially enlarged diagram of the surface thereof according to an embodiment of the invention.

FIG. 5 is a diagram showing the developing roller and a partially enlarged diagram of the surface thereof. The developing roller 44 is formed in a roller form of an approximate cylinder shape. On both ends of the developing roller in the longitudinal direction, a shaft 440 is disposed in an axis that is the same as that of the roller. In addition, the shaft 440 of the developing roller 44 is supported by the developing section main body, so that the entire developing roller 44 can be rotated. In a center portion 44*a* of the surface of the developing roller 44, as shown in the partial enlarged diagram (inside a dotted circle) of FIG. 5, a plurality of convex portions 441 that are regularly disposed and concave portions 442 surrounding the convex portions 441 are disposed.

For description below, the arrangement pitch of the convex portions 441 for the circumferential direction of the developing roller 44, that is, the moving direction of the circumferential face of the developing roller 44 is denoted by a sign P. In other words, the surface of the developing roller 44 has a structure in which a plurality of rows of convex portions 441, which is formed by disposing the convex portions 441 to be equally spaced at a constant pitch P along the circumferential direction of the developing roller 44, is disposed along the axis direction of the developing roller 44 to be equally spaced.

Each of the plurality of the convex portions 441 protrudes toward the front side of the sheet of FIG. 5. The top face of each convex portion 441 forms a part of a single cylindrical surface that has a rotation axis that is the same as that of the developing roller 44. In addition, the concave portions 442 are formed as continuous grooves that surround the peripheries of the convex portions 441 in a net shape. All the concave portions 442 form one cylindrical surface that has a rotation axis that is the same as that of the developing roller 44 and is different from the cylindrical surface formed by the convex portions. The convex portion 441 and the concave portion 442 that surround the convex portion are connected together by a gentle side face 443. In other words, a normal line of the side face 443 has an outward (the upper side in the figure) component in the radius direction of the developing roller 44, that is, a component for a direction departing away from the rotation axis of the developing roller 44.

Hereinafter, description of the image forming apparatus will be continued with reference back to FIG. 1. The toner image that is developed by the developing unit 4 as described above is primary-transferred onto the intermediate belt 71 of the transfer unit 7 in a primary transfer area TR1. The transfer unit 7 includes the intermediate transfer belt 71 that is hung on a plurality of rollers 72 to 75 and a driving unit (not shown)

that rotates the intermediate transfer belt 71 in a predetermined rotation direction D2 by driving rotation of the roller 73. When a color image is transferred onto a sheet S, a color image is formed by superimposing toner images of each color that are formed on the photosensitive body 22 on the intermediate transfer belt 71 and secondary transfer is performed for a color image on the sheet S that is taken out from a cassette B one after another and is transported up to the secondary transfer area TR2 along the transport path F.

At this moment, in order to transfer the image formed on the intermediate transfer belt 71 to a predetermined position on the sheet S correctly, a timing for sending the sheet S to the secondary transfer area TR2 is managed. In particular, a gate roller 81 is disposed on the front side of the secondary transfer area TR2 on the transport path F, and thus, the sheet S is transported to the secondary transfer area TR2 at a predetermined timing in accordance with rotation of the gate roller 81 that is adjusted to a timing of circulating movement of the intermediate transfer belt 71.

In addition, the sheet S on which the color image is formed as described above has the toner image fixed by the fixing unit 9 and is transported to a discharge tray unit 89 that is disposed on the top face portion of the apparatus main body through a pre-discharge roller 82 and a discharge roller 83. In addition, when images are to be formed on both sides of the sheet S, the rotation direction of the discharge roller 83 is reversed at a time point when a rear end portion of the sheet S, on one side of which the image is formed as described above is transported to a reverse position PR located on a rear side of the pre-discharge roller 82, and thereby the sheet S is transported in the direction of an arrow D3 along a reverse transport path FR. Then, the sheet S is loaded again in the transport path F prior to the gate roller 81. However, at this moment, the side of the sheet S which is brought into contact with the intermediate transfer belt 71 in the secondary transfer area TR2 and to which an image is transferred is opposite to the side on which the image has been transferred beforehand. Accordingly, the images can be formed on both sides of the sheet S.

In addition, as shown in FIG. 2, in the developing sections 4Y, 4C, 4M, and 4K, memories 91 to 94 in which data for production lots, use history, the remaining amounts of toner installed therein, and the like of the developers are stored are disposed. In addition, in the developing sections 4Y, 4C, 4M, and 4K, wireless communication parts 49Y, 49C, 49M, and 49K are disposed. As needed, the communication parts 49Y, 49C, 49M, and 49K selectively perform data communication with a wireless communication part 109 that is disposed on the main body side in a non-contacting manner and perform data transmission and data reception between the CPU 101 and the memories 91 to 94 through the interface 105, whereby managing various types of information such as information on management of supplies of the developing sections. In addition, according to this embodiment, data transmission and data reception are performed in a non-contacting manner by using electronic units such as wireless communication parts. However, it may be configured that connectors or the like are disposed on the main body side and the developing section sides, and data transmission and data reception therebetween are performed by mechanically fitting the connectors or the like together.

In addition, this apparatus, as shown in FIG. 2, includes a display unit 12 that is controlled by a CPU 111 of the main controller 11. This display unit 12, for example, is configured by a liquid crystal display. The display unit 12 displays predetermined messages that are used for informing a user of operation guide, a progress state of an image forming operation, occurrence of a problem in the apparatus, time for replacing several units, and the like in accordance with control directions transmitted from the CPU 111.

A reference numeral 113 shown in FIG. 2 is an image memory that is disposed in the main controller 11 for storing an image provided from an external apparatus such as a host computer through an interface 112. In addition, a reference numeral 106 is a ROM that is used for storing an operation program executed by the CPU 101, control data for controlling the engine unit EG, and the like. A reference numeral 107 is a RAM that temporarily stores an operation result of the CPU 101 or other data.

In addition, near the roller 75, a cleaner 76 is disposed. This cleaner 76 is configured so as to be able to be moved to be close to or far from the roller 75 by using an electronic clutch that is not shown in the figure. In the state in which the cleaner 76 is moved to the roller 75 side, a blade of the cleaner 76 is brought into contact with the surface of the intermediate transfer belt 71 that is hung over the roller 75, and thereby removing the remaining toner attached to the outer circumferential face of the intermediate transfer belt 71 after the secondary transfer.

In addition, near the roller 75, a density sensor 60 is disposed. This density sensor 60 is disposed so as to face the surface of the intermediate transfer belt 71. As needed, the density sensor 60 measures the image density of the toner image that is formed on the outer circumferential face of the intermediate transfer belt 71. Then, based on the result of measurement, this apparatus performs adjustment of operating conditions of each unit of the apparatus that influences the image quality, for example, a developing bias that is applied to each developing section, the intensity of the exposure beam L, a gray scale correcting characteristic of the apparatus, and the like.

This density sensor 60 is configured to output a signal corresponding to the contrasting density of an area of a predetermined area on the intermediate transfer belt 71, for example, by using a reflection-type photo sensor. Then, the CPU 101 can detect the image density of each portion of the toner image on the intermediate transfer belt 71 by regularly sampling an output signal output from this density sensor 60 while circulating the intermediate transfer belt 71.

Next, regulation of the toner layer on the developing roller 44 in the developing section 4K or the like of the image forming apparatus configured as above will be described in detail. In the configuration in which concave portions and convex portions are disposed on the surface of the developing roller 44 that carries toner as described above, toner can be carried on both sides of the convex portions 441 and concave portions 442. However, in this embodiment, the toner of the convex portions 441 is removed by directly bringing the regulating blade 46 into contact with the convex portions 441 of the surface of the developing roller 44. The reason is as follows.

First, in order to form a uniform toner layer in the convex portion 441, a gap between the regulating blade 46 and the convex portion 441 needs to be managed precisely. However, in order to carry the toner only in the concave portions 442, it is preferable that all the toner of the convex portions 441 is removed by bringing the regulating blade 46 and the convex portions 442 in contact with each other. Accordingly, implementation of carrying the toner only in the concave portions 442 is relatively simple. In addition, the amount of toner to be transported is determined based on the volume of a space formed in a gap between the regulating blade 46 and the concave portion 442. Accordingly, the amount of transport of the toner can be stabilized.

In addition, there is also an advantage that the toner layer is excellent. In other words, when toner is carried in the convex portion 441, deterioration of the toner may easily occur due to rubbing between the regulating blade 46 and the toner. In particular, there is a problem that fluidity or electrical charging of the toner is degraded, the toner is in a powder state to be aggregated or fixed to the developing roller 44 so as to generate filming, or the like. On the contrary, when the toner is carried in the concave portion 442 that does not receive a pressing force from the regulating blade 46 much, the above-described problems cannot easily occur. In addition, a method in which the toner carried in the convex portion 441 is rubbed with the regulating blade 46 and a method in which the toner carried in the concave portion 442 is in contact with the regulating blade 46 are different much from each other. Accordingly, a variation of the charged amounts of the toner is predicted to be large. However, by carrying the toner only in the concave portion 442, such a variation is suppressed.

Furthermore, recently, in order to implement high definition of an image or reduction in the amount of toner consumption and power consumption, a decrease in the particle diameter of toner and a decrease in the fixing temperature have been requested. The configuration of this embodiment can also respond to such a request. Although the rise of electrical charging of small-diameter toner is slow, the amount of saturated charging of the small-diameter toner is large. Accordingly, the amount of electrical charging of the toner carried in the convex portion 441 tends to be markedly larger (overcharged) than that of the toner carried in the concave portion 442. Such a difference of the amounts of electrical charging appears as so-called a developing history in an image. In addition, low-melting point toner can be easily fixed together or easily fixed to the developing roller 44 or the like due to rubbing. However, under the configuration of this embodiment in which toner is carried only in the concave portions 442, such a problem does not occur.

Next, the frequency of the developing bias Vb will be described. According to this embodiment, by maintaining predetermined correlation among parameters of the frequency of the developing bias Vb, an arrangement pitch of the convex portions 441 of the developing roller 44, and the peripheral speed (or the rotation speed) of the developing roller 44, high efficiency of the developing process is acquired. Hereinafter, this point will be described in detail.

Figure 6A:
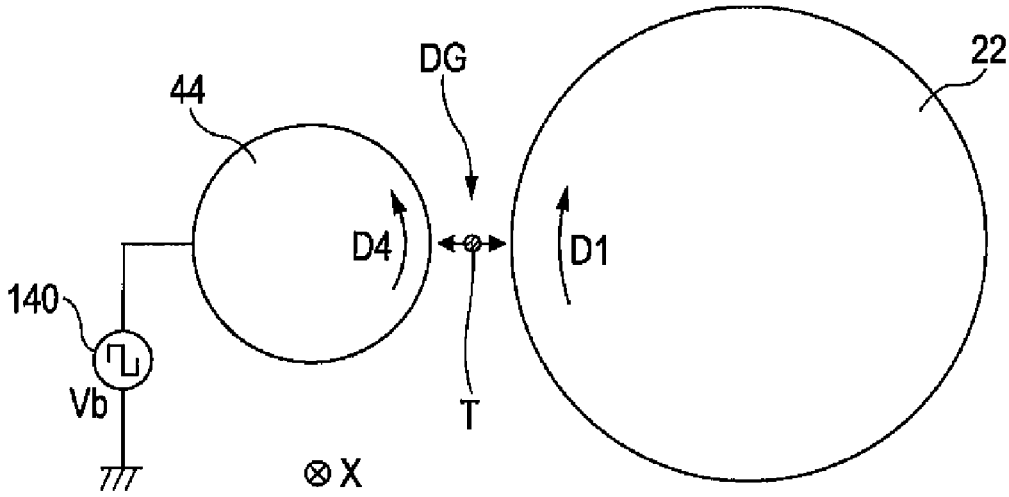
FIGS. 6A and 6B are schematic diagrams showing a developing gap according to an embodiment of the invention.
Figure 6B:
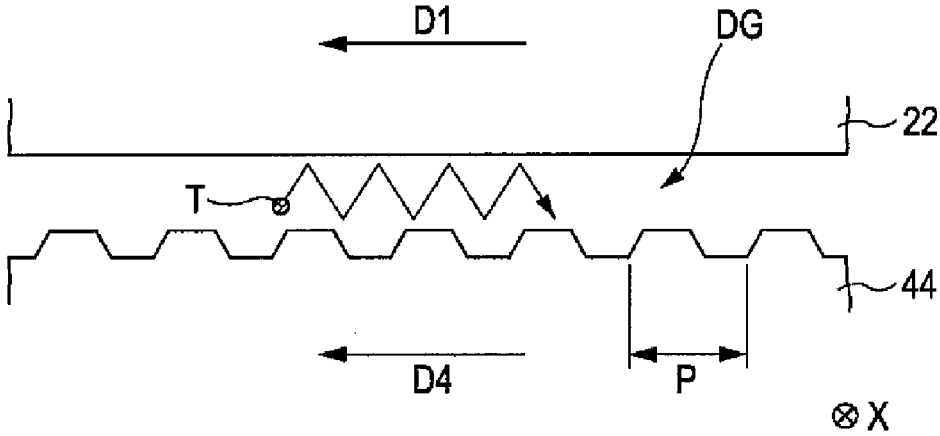

FIGS. 6A and 6B are schematic diagrams showing a developing gap. By the action of an alternating electric field that is formed in the developing gap DG in accordance with the developing bias Vb applied to the developing roller 44 from the bias power source 140, as shown in FIG. 6A, the toner T reciprocates in the developing gap DG between the developing roller 44 and the photosensitive body 22. The period of the reciprocation is a reciprocal number of the frequency of the developing bias. Even while the toner flying from the surface of the developing roller 44 reciprocates as described above, the surface of the developing roller 44 is moved in the direction D4. Accordingly, when viewed from the surface of the developing roller 44, as shown in FIG. 6B, the toner T is relatively moved to a direction opposite to the direction D4 while reciprocating in the developing gap DG up to the photosensitive body 22. According to this embodiment, as described below, the amount of movement of the surface of the developing roller 44 during a period in which the toner reciprocates once is configured to be the exactly same as the arrangement pitch P of the convex portions 441.

FIGS. 7A and 7B are diagrams showing the relationship between the arrangement pitch of the convex portions and the amount of movement of the surface of the developing roller, according to this embodiment. When a moving speed of the surface of the developing roller 44 for the circumferential direction that is accompanied by the rotation of the developing roller 44 is denoted by V, and the frequency of the developing bias Vb is denoted by F, as shown in FIG. 7A, the distance for reciprocating the toner once due to the action of the alternating electric field E that is formed in the developing gap DG in accordance with the developing bias Vb, that is, a relative moving distance of the toner and the surface of the developing roller 44 during a time (1/F) corresponding to one period of the developing bias Vb can be represented as V/F.

According to this embodiment, the frequency F of the developing bias Vb is set such that the relative moving distance "V/F" is the same as the arrangement pitch P of the convex portions 441 on the surface of the developing roller 44. In other words, according to this embodiment, the arrangement pitch P of the convex portions 441, the moving speed V of the surface of the developing roller 44, and the frequency F of the developing bias are set such that the following equation is satisfied.

$$V/F=P \quad \text{(Equation 1)}$$

For example, when the arrangement pitch of the convex portions 441 is 100 μm, by setting the moving speed, that is, the peripheral speed of the surface of the developing roller 44 to 400 mm/sec and the frequency of the developing bias Vb to 4 KHz, the above-described relationship of Equation 1 can be satisfied.

Accordingly, as shown in FIG. 7A, toner T1 that is carried in the concave portions 442 and flies due to the action of the alternating electric field E is relatively moved by the arrangement pitch P of the convex portions with respect to the surface of the developing roller 44 during one reciprocation so as to jump into an adjacent concave portion. Also in this concave portion, toner T2 that starts to fly due to the action of the alternating electric field E is generated, and toner T3 that cannot fly due to only the action of the electric field is sent out due to collision of the toner T1 accelerated by the electric field so as to start to fly. As the toner that does not fly due to only the action of the electric field, for example, there are toner for which the action of the electric field is weak due to insufficient amount of electrical charging and toner that is strongly drawn to the surface of the developing roller 44 due to an image force. Even the toner that cannot easily fly as described above is sent out due to jumped-in toner. Accordingly, when the toner starts to fly once, the toner reciprocates in the developing gap DG, and whereby contributing to a developing process. Then, the toner flying as described above jumps in another concave portion additionally so as to induce flight of new toner.

As described above, according to this embodiment, the relative moving amount (V/F) of the toner and the surface of the developing roller 44 during one reciprocation of toner that reciprocates in accordance with application of the developing bias Vb is configured to be the same as the arrangement pitch P of the convex portions 441 for the circumferential direction on the surface of the developing roller 44. Accordingly, when the toner carried in the concave portion fly so as to reciprocate once, the toner serves to jump into another concave portion and induce flight of new toner. By sequentially repeating the above-described operation, the toner that does not fly due to only the action of the electric field can fly in the developing gap DG so as to contribute to a developing process. In other words, the efficiency of the developing process can be improved. As a result, according to this embodiment, an electrostatic latent image can be toner-developed with sufficient image density by acquiring the sufficient amount of flight of toner in the developing gap DG.

In addition, it is apparent that the relationship between the peripheral speed of the developing roller 44 and the frequency of the developing bias Vb can be defined as described above since the structure of the surface of the developing roller 44 is regular and has periodicity. For a developing roller of which the surface is processed by blast processing, the structure of the surface is irregular and does not have a specific periodicity, and accordingly, such relationship cannot be defined.

In addition, according to this embodiment, attachment of toner to the convex portion 441 of the surface of the developing roller 44 is regulated by the regulating blade 46 in the upstream side relative to the developing gap DG for the rotation direction D4 of the developing roller 44. When toner is not carried in the convex portion 441, a part of the surface of the developing roller 44 does not contribute to transport of the toner, and accordingly, the amount of transport of the toner may be decreased. However, according to this embodiment, by sending toner out by using the flying toner, the toner that is carried in the deep portion of the concave portion and cannot easily fly due to only the action of the electric field can fly. Accordingly, much more toner can be carried by increasing a height difference between the convex portion 441 and the concave portion 442. As a result, the amount of flight of toner in the developing gap DG can be increased, as well.

In other words, a sufficient amount of toner can be carried in the concave portions 442, and the toner can be flown efficiently. Accordingly, the need for carrying the toner additionally in the convex portions 441 is small. The advantage acquired from not carrying the toner in the convex portions 441 has been described as above. However, according to this embodiment, the following advantages can be acquired additionally.

As described above, according to this embodiment, external leakage of the toner is prevented by bringing the sealing member 47 into contact with the surface of the developing roller 44 in a position located on the downstream side relative to the developing gap DG in the rotation direction D4 of the developing roller 44. Here, when toner is carried in the convex portion 441, the toner is pressed between the convex portion 441 and the sealing member 47 so as to be fixed to the surface of the developing roller 44 or the surface of the sealing member 47. Accordingly, there is a problem such as a decrease in the sealing effect or occurrence of filming. According to this embodiment, the toner carried in the concave portions 442 is configured to enter into the concave portions 442 after being flown in the developing gap DG. Accordingly, attachment of the toner to the convex portion 441 in the downstream side of the developing gap DG is suppressed to be at a minimum level. As a result, attachment of the toner to the surface of the developing roller 44 or the surface of the sealing member 47 can be suppressed effectively.

On the contrary, when the arrangement pitch P of the convex portions 441, the moving speed V of the surface of the developing roller 44, and the frequency F of the developing bias are arbitrarily set, the toner going out from the concave portion 442 not only jumps into another concave portion but also collides with the convex portion 441. Accordingly, in addition to weakening the effect of sending out the toner, there may be a problem such as attachment of the toner collided with the convex portion 441 to the convex portion 441 due to the image force so as to decrease the efficiency of the developing process, occurrence of filming, or the like.

FIG. 7A shows a case where toner flying from one concave portion 442 reciprocates once so as to enter into an adjacent concave portion. However, in the view point that toner flying from one concave portion enters into another concave portion, the place into which the toner enters needs not to be the adjacent concave portion. For example, as shown in FIG. 7B, a configuration in which flying toner T4 enters into a concave portion, which is located on the front side further, so as to send out toner T5 by skipping over an adjacent concave portion may be used. Generally, the relationship of the following equation needs to be satisfied.

$$V/F=n\cdot P \text{ (where } n \text{ is a natural number)} \quad \text{(Equation 2)}$$

The examples shown in FIGS. 7A and 7B correspond to cases where n=1 and n=2 in Equation 2.

However, in the point that the efficiency of the developing process is increased by using a phenomenon that the flying toner sends out other toner carried in the concave portion, it is preferable that the number of times that the flying toner enters into another concave portion is increased as possibly as can be. Thus, a case where n=1 in which the number of times of reciprocating the toner is the maximum is the most preferable.

In addition, in the above-described example, a case where the amount (V/F) of the relative movement of the toner and the surface of the developing roller 44 during one reciprocation of the toner is a value acquired from multiplying the arrangement pitch P of the convex portions by a natural number has been described. However, practically, equality in the above-described Equation 1 or Equation 2 may not be satisfied precisely, and a difference of some degree from a case where the equality is satisfied may be allowed. That is because a time in which one piece of the toner reciprocates in the developing gap DG is very short, and movement of the toner from a concave portion to a concave portion needs to be assured only during the limited reciprocating time. One example in which this point is considered will be described with reference to FIGS. 8A, 8B, and 8C.

Figure 8A:
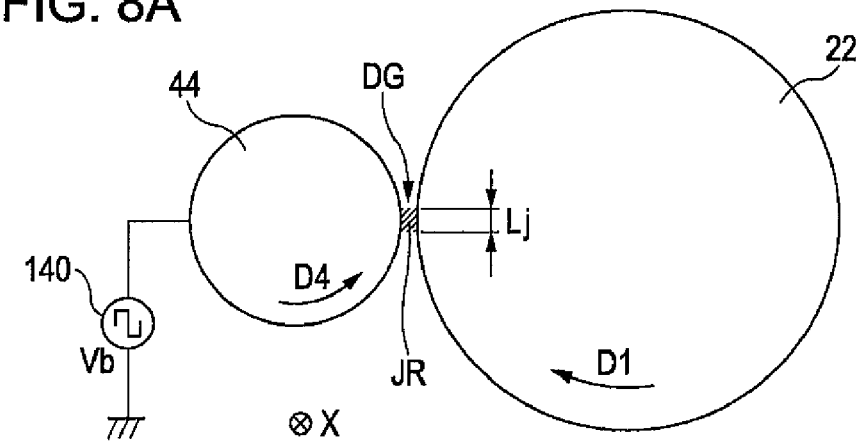
FIGS. 8A to 8C are diagrams showing relationship between broadening of the developing gap and a reciprocating pattern of toner according to an embodiment of the invention.
Figure 8B:
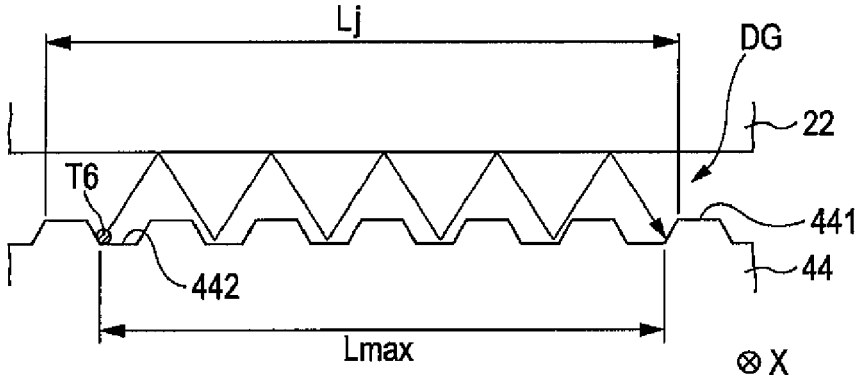
Figure 8C:
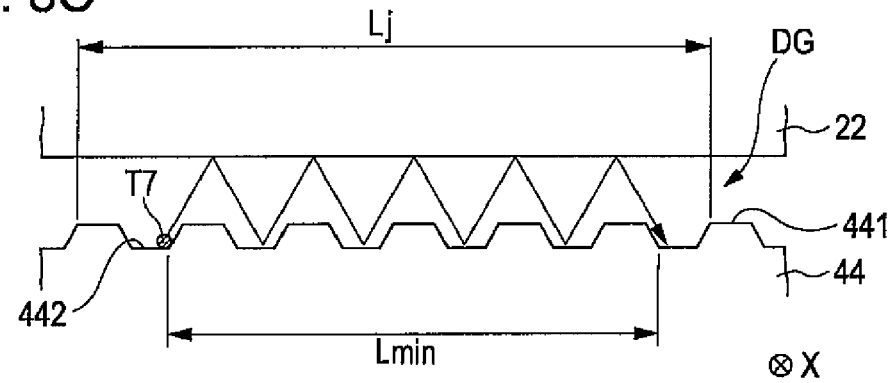

FIGS. 8A to 8C are diagrams showing relationship between broadening of the developing gap and a reciprocating pattern of the toner. As denoted by hatching in FIG. 8A, in the developing gap DG in which the developing roller 44 and the photosensitive body 22 face each other, flight of the toner occurs only in a partial area in which a distance between the developing roller 44 and the photosensitive body 22 becomes the shortest and the intensity of the electric field is the strongest. This area may be considered as the developing gap in the narrow meaning. However, for easy understanding, hereinafter, this area is referred to as a "flight area JR". In addition, the length of the flight area JR for the circumferential direction of the developing roller 44 is denoted by a reference sign Lj.

Here, toner carried in a specific concave portion 442 will be considered. When the concave portion reaches the flight area JR in accordance with rotation of the developing roller 44, flight of the toner is started. The flying toner repeats sequentially entering into other concave portions within the flight area JR in accordance with the reciprocating movement. The number of times of reciprocating one piece of toner is roughly determined based on the number of the concave portions 442 that are included in the flight area JR. When the arrangement pitch of the convex portions 441 is P for the length Lj of the flight area JR, the number of times m of repeating the concave and convex portions of the surface of the developing roller 44 in the flight area JR can be represented roughly by the following equation.

$$m=Lj/P \quad \text{(Equation 3)}$$

For example, when the arrangement pitch P of the convex portions is 100 μm and the length Lj of the flight area JR is 2 mm, m=20. In other words, 20 times of repeating the concave and convex portions are included within the flight area JR.

The number of times of reciprocating until the toner started flying in the first concave portion is sequentially moved to the m-th concave portion is (m−1). In other words, the maximum number of times of reciprocating of the toner started flying within the flight area JR is about (m−1). During this number of times of reciprocating, toner that is originally placed in the concave portion may not be moved into the convex portion.

FIGS. 8B and 8C show examples in which the concave and the convex portions are repeated six times in the flight area JR. In other words, m=6, and the number of times of reciprocating of the toner is five times at this moment. FIG. 8B shows a case where the value of the amount (V/F) of relative movement of the toner and the developing roller 44 during reciprocating of the toner once becomes a maximum value allowed. In the case, toner T6 placed in the position (the left end in the figure) of the end portion located on the downmost stream side within one concave portion reciprocates five times so as to be attached to the position (the right end in the figure) of the end portion located on the uppermost stream side within the sixth concave portion and ends the flight. On the contrary, FIG. 8C shows a case where the value of the amount (V/F) of relative movement becomes a minimum value allowed. In the case, toner T7 placed in the position of the end portion located on the downmost stream side within one concave portion reciprocates five times so as to be attached to the position of the end portion located on the downmost stream side within the sixth concave portion and ends the flight. Both the cases are extreme cases where toner cannot be moved into the convex portion during five times of reciprocating of the toner.

In the cases shown in FIGS. 8B and 8C, moving distances during five times of reciprocating of the toner are denoted by reference signs Lmax and Lmin. In such a case, the relative moving distance is (V/F) of the toner and the developing roller 44 in reciprocating of the toner once, and the relative moving distance for reciprocating of the toner five times is 5 (V/F). Accordingly, the following equation represents an allowed range of the amount (V/F) of relative movement of the toner and the developing roller 44 in the reciprocating of the toner once.

$$L\min \leqq 5\times(V/F) \leqq L\max \quad \text{(Equation 4)}$$

Generally, the following equation represents the allowed range of the amount of the relative movement.

$$L\min \leqq (m-1)\times(V/F) \leqq L\max \quad \text{(Equation 4A)}$$

Here, more precisely, Lmax and Lmin need to be considered based on the structure of the surface of the developing roller 44, for example, the size of the convex portion 441 the width of the concave portion 442, and the like. However, here, it is simply assumed that the convex portion 441 and the concave portion 442 occupy the length of a half of the arrangement pitch P, respectively. In such a case, in the example shown in FIG. 8B, six concave portions and five convex portions are included within the length Lmax. Accordingly, Lmax can be represented by the following equation.

$$L\max=(5+6)\times P/2 \quad \text{(Equation 5)}$$

Similarly, four concave portions and five convex portions are included in the length Lmin, and thus, Lmin can be represented by the following equation.

$$L\min=(4+5)\times P/2 \quad \text{(Equation 6)}$$

Generally, Lmax and Lmin can be represented by the following equations.

$$L\max=\{(m-1)+m\}\times P/2=(2m-1)\times P/2 \quad \text{(Equation 5A)}$$

$$L\min=\{(m-2)+(m-1)\}\times P/2=(2m-3)\times P/2 \quad \text{(Equation 6A)}$$

Accordingly, the flowing relational equation is acquired from Equations 4A, 5A, and 6A.

$$(1-Q)\times P \leqq V/F \leqq (1+Q)\times P \quad \text{(Equation 7)}$$

Here, $Q=1/\{2\times(m-1)\}$

Accordingly, it can be known that the relative moving amount (V/F) of the toner and the surface of the developing roller during reciprocating of the toner once needs to be within a predetermined range in which a value same as the arrangement pitch P of the convex portions is positioned on the center. In other words, when the relationship of Equation 7 is satisfied, it is assured that toner originally carried in the concave portion 442 repeats entering into the concave portions 442 during reciprocating flight of the toner at least within the flight area JR. In addition, it can be known that when the length Lj of the flight area JR is short, and the number of times m of repeating the concave and convex portions of the surface of the developing roller 44 included within the flight area JR is small, the allowed range of the relative moving amount (V/F) is relatively wide. On the other hand, as the length Lj of the flight area JR is increased so as to increase the number of times m of repeating the concave and concave portions, the allowed range of the relative moving amount (V/F) is narrowed so as to converge to a value that is the same as the arrangement pitch P.

In other words, when Q=0 (m=∞) in Equation 7, that is, when the relationship of Equation 1 is satisfied, movement of the toner from the concave portion to the concave portion can be performed assuredly even for a case where the flight area JR is maximally widened. In an actual apparatus, the flight area JR determined based on the sizes of each unit is limited. Accordingly, when the relationship of the above-described Equation 7 is satisfied in accordance with the area, the toner flying from the concave portion is entered into the concave portion assuredly. Therefore, the advantages according to the embodiments of the invention can be acquired. Here, a case where n=1 has been considered. However, for a case where n is equal to or larger than two, similarly, a relational expression corresponding to the above-described Equation 7 can be driven based on the number of times of reciprocating of the toner that is considered in the flight area JR.

As described above, according to this embodiment, the photosensitive body 22, the developing roller 44, and the bias power source 140 serve as an "image carrier", a "toner carrying roller", and a "bias applying unit" according to an embodiment of the invention. In addition, the regulating blade 46 and the sealing member 47 that are disposed in the housing 41 of the developing sections serve as a "regulating unit" and a "sealing member" according to an embodiment of the invention.

In addition, the invention is not limited to the above-described embodiment, and various changes from the description above can be made therein without departing from the gist of the invention. For example, the above-described embodiment is an image forming apparatus of so-called a jumping phenomenon type in which the photosensitive body 22 and the developing roller 44 are disposed to face each other with a predetermined gap interposed therebetween and toner is allowed to fly therebetween. However, the invention may be applied to an apparatus that applies an AC developing bias in a state in which the photosensitive body 22 and the developing roller 44 are brought into contact with each other.

In addition, the waveform of the developing bias is not limited to a square wave. Thus, for example, as the waveform of the developing bias, a triangle wave or a sinusoidal wave may be used. In addition, as long as the period is constant and the above-described relational expressions are satisfied, the duty ratio of the waveform may be a value other than 1:1.

In addition, the structure of the surface of the developing roller 44 according to the above-described embodiment is a structure in which a plurality of convex portions 441, of which the top faces are approximately a lozenge shape, is arranged. However, when the arrangement pitch P for the circumferential direction is constant, the shape of the convex portion is not limited thereto. Thus, as the shape of the convex portion, any arbitrary shape may be used.

In addition, in the above-described embodiment, the relationship of the arrangement pitch P of the convex portions 441 on the surface of the developing roller 44, the peripheral speed V, and the frequency F of the developing bias has been defined. However, a case where the arrangement pitch of the convex portions 441 is replaced by the arrangement pitch of the concave portions 442 of a groove shape that surround the convex portions 441 is technically equivalent to the above-described embodiment.

In addition, the structure of the surface of the developing roller 44 according to this embodiment may be regarded to be configured by a concave portion 442 that is configured by a plurality of grooves intersecting each other and convex portions 441 that are surrounded by the grooves. On the other hand, the invention may be applied to an image forming apparatus using a developing roller having a surface structure in which a plurality of grooves that are parallel to one another so as not to intersect one another is formed at a constant pitch in the circumferential direction. In such a case, the direction of extending the grooves may be any one of a direction parallel to the direction of the rotation axis or a direction crooked from the direction except for a direction perpendicular to the direction of the rotation axis of the roller in which there is no arrangement for the circumferential direction.

In addition, the image forming apparatus according to the above-described embodiment is the color image forming apparatus that is configured by installing the developing section 4K and the like to the rotary developing unit 4. However, the applied target of the invention is not limited thereto. For example, the invention may be applied to a color image forming apparatus of so-called a tandem type in which a plurality of developing sections is aligned along the intermediate transfer belt or a monochrome image forming apparatus that includes only one developing section and forms a monochrome image.

The entire disclosure of Japanese Patent Application No. 2008-140406, filed May 29, 2008 is expressly incorporated by reference herein.

What is claimed is:

1. An image forming apparatus comprising:

an image carrier that carries an electrostatic latent image on a surface thereof;

a toner carrying roller that is disposed to face the image carrier and rotates in a predetermined rotation direction with charged toner carried on a surface thereof so as to transport the toner in an opposing position for facing the image carrier; and a bias applying unit that develops the electrostatic latent image with the toner by applying an AC voltage as a developing bias to the toner carrying roller, wherein periodical concavo-convexes that are formed of a plurality of convex portions arranged at a constant pitch in a circumferential direction and concave portions that surround the plurality of convex portions are formed on the surface of the toner carrying roller, and wherein, when the arrangement pitch is denoted by P, the frequency of the developing bias is denoted by F, and the moving speed of the surface of the toner carrying roller for the circumferential direction is denoted by V, a quotient acquired from dividing V by F is a value acquired from multiplying P by a natural number.

2. The image forming apparatus according to claim 1, wherein the quotient acquired from dividing V by F is the same as P.

3. The image forming apparatus according to claim 1, wherein the image carrier and the toner carrying roller are disposed to face each other with a predetermined gap interposed therebetween.

4. The image forming apparatus according to claim 1, further comprising a regulating unit that is brought into contact with the surface of the toner carrying roller on an upstream side relative to the opposing position in the rotation direction of the toner carrying roller and regulates attachment of the toner to top faces of the plurality of convex portions.

5. The image forming apparatus according to claim 1, further comprising a sealing member that prevents leakage of the toner from a housing is interposed in a gap between the surface of the toner carrying roller and the housing on a downstream side relative to the opposing position in the direction of rotation of the toner carrying roller, wherein a shaft of the toner carrying roller is attached to the housing, which stores the toner therein, so as to be rotatable.

6. An image forming apparatus comprising:

an image carrier that carries an electrostatic latent image on a surface thereof;

a toner carrying roller that is disposed to face the image carrier and rotates in a predetermined rotation direction with charged toner carried on a surface thereof so as to transport the toner in an opposing position for facing the image carrier; and a bias applying unit that develops the electrostatic latent image with the toner by applying an AC voltage as a developing bias to the toner carrying roller, wherein a plurality of grooves that is arranged at a constant pitch in a circumferential direction is disposed on the surface of the toner carrying roller, and wherein, when the arrangement pitch is denoted by P, the frequency of the developing bias is denoted by F, and the moving speed of the surface of the toner carrying roller for the circumferential direction is denoted by V, a quotient acquired from dividing V by F is a value acquired from multiplying P by a natural number.

7. An image forming method comprising:

forming an electrostatic latent image on a surface of an image carrier; and developing the electrostatic latent image with toner by applying an AC voltage as a developing bias to a toner carrying roller by disposing the toner carrying roller, which rotates in a predetermined direction with charged toner carried on a surface thereof, so as to face the image carrier, wherein periodical concavo-convexes that are formed of a plurality of convex portions arranged at a constant pitch in a circumferential direction and concave portions that surround the plurality of convex portions are formed on the surface of the toner carrying roller, and wherein, when the arrangement pitch is denoted by P, the frequency of the developing bias is denoted by F, and the moving speed of the surface of the toner carrying roller for the circumferential direction is denoted by V, a quotient acquired from dividing V by F is a value acquired from multiplying P by a natural number.

* * * * *